US011086258B2

(12) United States Patent
Izaki et al.

(10) Patent No.: US 11,086,258 B2
(45) Date of Patent: Aug. 10, 2021

(54) IMAGE FORMING APPARATUS THAT DETECTS TONER FOGGING

(71) Applicant: CANON KABUSHIKI KAISHA, Tokyo (JP)

(72) Inventors: Yu Izaki, Suntou-gun (JP); Masahiro Suzuki, Numazu (JP); Shun-ichi Ebihara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/925,021

(22) Filed: Jul. 9, 2020

(65) Prior Publication Data

US 2021/0018872 A1 Jan. 21, 2021

(30) Foreign Application Priority Data

Jul. 19, 2019 (JP) ..... JP2019-134015

(51) Int. Cl.
*G03G 15/00* (2006.01)
*G03G 15/08* (2006.01)

(52) U.S. Cl.
CPC ..... *G03G 15/5062* (2013.01)

(58) Field of Classification Search
CPC ..... G03G 15/5062
USPC ..... 399/15
See application file for complete search history.

(56) References Cited

U.S. PATENT DOCUMENTS 7,877,029 B2 * 1/2011 Sako et al. ..... G03G 15/5033 399/49
8,483,583 B2 * 7/2013 Takehara et al. .. G03G 15/0131 399/29
8,594,519 B2 11/2013 Nakatake et al.

FOREIGN PATENT DOCUMENTS

JP 08-82965 A 3/1996
JP 2011-164334 A 8/2011
JP 2018-112636 A 7/2018
JP 2019-040136 A 3/2019

* cited by examiner

*Primary Examiner* — William J Royer
(74) *Attorney, Agent, or Firm* — Venable LLP

(57) ABSTRACT

An image forming apparatus sets, on an image forming unit, one of a first transfer condition that does not cause an image to be formed on a sheet and a second transfer condition that causes an image to be formed on the sheet. The apparatus generates a first reading result by reading the sheet that has passed through the image forming unit set in the first transfer condition, and generates a second reading result by reading the sheet that has passed through the image forming unit set in the second transfer condition. The apparatus detects toner fogging based on the first reading result and a reading result out of the second reading result, the reading result concerning a non-image region in which no image is formed on a surface of the sheet.

17 Claims, 7 Drawing Sheets

IMAGE FORMING APPARATUS THAT DETECTS TONER FOGGING

BACKGROUND OF THE INVENTION

Field of the Invention

The present invention relates to an image forming apparatus that detects toner fogging.

Description of the Related Art

Japanese Patent Laid-Open No. 2018-112636 suggests that whether there is "toner fogging" be detected by reading a sheet, and that process adjustment be executed so as to reduce "toner fogging". Hereinafter, toner fogging may simply be referred to as "fogging". "Fogging" is a phenomenon in which toner attaches to an unintended region within a region on a sheet.

Meanwhile, once the design life of a developer has expired, it is difficult to reduce fogging even if the process adjustment is executed. In this case, the developer needs to be replaced. However, replacing the developer before the expiration of the design life of the developer is a waste of a resource. Therefore, there is a demand that the time of replacement of the developer be accurately known by detecting fogging more accurately. According to Japanese Patent Laid-Open No. 2018-112636, the background density of a sheet is obtained by reading a back surface of the sheet while forming an image on a front surface of the sheet, and the density of a region in which no image is formed on the front surface of the sheet is further obtained. By comparing these densities, whether there is fogging is detected. However, a toner stain on an image carrier and a transfer roller is not taken into consideration in Japanese Patent Laid-Open No. 2018-112636. This toner stain causes an error in the result of detection of the background density. Therefore, in order to detect fogging more accurately, it is necessary to detect the background density of the sheet with high precision. In view of this, an object of the present invention is to detect fogging more accurately.

SUMMARY OF THE INVENTION

The present invention provides an image forming apparatus comprising the following elements. A conveyance unit conveys a sheet. An image forming unit forms an image by transferring toner to the sheet conveyed by the conveyance unit. A setting unit sets, on the image forming unit, one of a first transfer condition that does not cause an image to be formed on the sheet and a second transfer condition that causes an image to be formed on the sheet. A reading unit generates a first reading result by reading the sheet that has passed through the image forming unit set in the first transfer condition, and generates a second reading result by reading the sheet that has passed through the image forming unit set in the second transfer condition. A detection unit detects toner fogging based on the first reading result and a reading result out of the second reading result, the reading result concerning a non-image region in which no image is formed on a surface of the sheet.

Further features of the present invention will become apparent from the following description of exemplary embodiments (with reference to the attached drawings).

DESCRIPTION OF THE EMBODIMENTS

Figure 1:
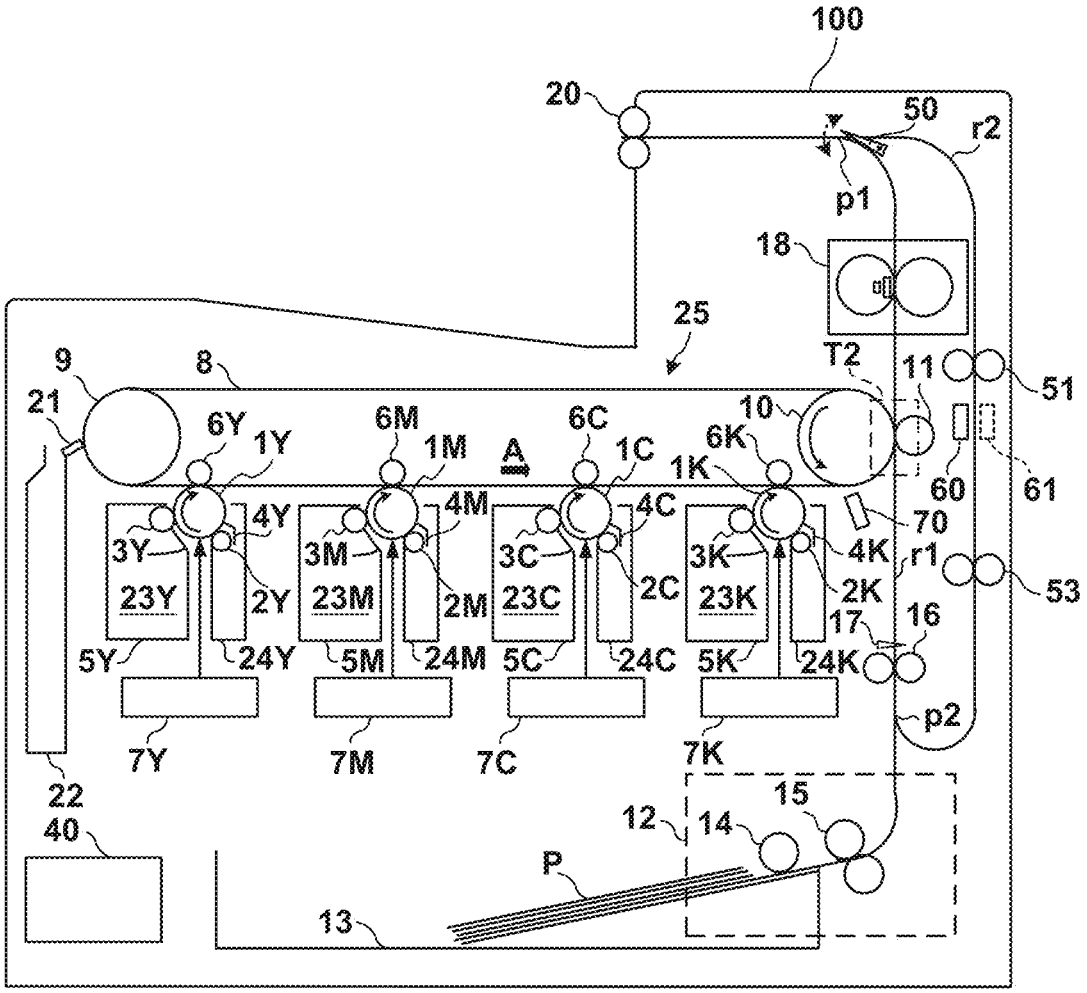
FIG. 1 is a diagram showing an image forming apparatus.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

<Image Forming Apparatus>

FIG. 1 shows an image forming apparatus 100 of an electrophotographic method that forms a multi-color image. Process stations (process cartridges) 5Y, 5M, 5C, and 5K are attachable to and removable from the image forming apparatus 100, and are main components of an image forming unit 25. Although the four process stations 5Y, 5M, 5C, and 5K are structured in the same way, the colors of toner therein are different from one another. Y, M, C, and K appended at the end of reference signs refer to yellow, magenta, cyan, and black, which are the colors of toner. Hereinafter, the letters of Y, M, C, and K will be omitted, excluding the case where a specific process station is explained. A toner container 23 is a container that holds toner. A photosensitive drum 1 is an image carrier that carries an electrostatic latent image and a toner image. A charging roller 2 uniformly charges a surface of the photosensitive drum 1. An exposure apparatus 7 scans the surface of the photosensitive drum 1 with laser light in accordance with input image data, and forms an electrostatic latent image corresponding to the image data on the surface of the photosensitive drum 1. A development roller 3 develops the electrostatic latent image by attaching the toner held in the toner container 23 to the electrostatic latent image, thereby forming a toner image. A primary transfer roller 6 transfers the toner image carried by the photosensitive drum 1 to an intermediate transfer belt 8. The intermediate transfer belt 8 is hung in a stretched state between a driving roller 9 and an opposing roller 10, and is rotated by the driving roller 9 in the direction of arrow A. The rotation of the intermediate transfer belt 8 causes the opposing roller 10 to also rotate in coordination. A cleaning blade 4 is a cleaning member that collects toner left on the surface of the photosensitive drum 1 into a collection container 24.

A feeding apparatus 12 feeds sheets P to a main conveyance path r1. The main conveyance path r1 is a conveyance path that extends from a feeding cassette 13 to a reverse point p1. The feeding apparatus 12 basically feeds the sheets so that an interval between a preceding sheet and a following sheet is a fixed interval. This is derived from the fact that the process station 5 forms an image to be transferred to the preceding sheet and an image to be transferred to the following sheet on the intermediate transfer belt 8 at a fixed interval. A feeding roller 14 sends a sheet P stored in the feeding cassette 13 to a conveyance roller pair 15. The conveyance roller pair 15 sends the sheet P to a registration roller pair 16. The registration roller pair 16 conveys the sheet P so that the timing at which a toner image conveyed by the intermediate transfer belt 8 arrives at a secondary transfer portion T2 matches the timing at which the sheet P conveyed by the registration roller pair 16 arrives at the secondary transfer portion T2. For example, a controller 40 adjusts the rotation speed and the rotation resuming time of the registration roller pair 16 based on the timing of detection of the sheet P by a sheet sensor 17.

A secondary transfer roller 11 transfers the toner image carried by the intermediate transfer belt 8 to the sheet P. The secondary transfer roller 11 and the intermediate transfer belt 8 form the secondary transfer portion T2. A cleaning blade 21 is a cleaning member that collects toner left on a surface of the intermediate transfer belt 8 after the completion of the secondary transfer into a collection container 22. The sheet P sandwiched between the intermediate transfer belt 8 and the secondary transfer roller 11 is sent to a fixing device 18. The fixing device 18 fixes the toner image on the sheet P by applying heat and pressure to the sheet P and the toner image. The sheet P on which the image formation has been completed is guided by a flapper 50 from the main conveyance path r1 to a discharge roller pair 20, and the discharge roller pair 20 discharges the sheet P to a discharge tray.

When an image is to be formed on a second surface of the sheet P, the controller 40 causes the discharge roller pair 20 to rotate in reverse, and also switches the flapper 50. As a result, the conveyance direction of the sheet P is reversed, and thus the front and back of the sheet P are reversed. The flapper 50 guides the sheet P to a sub conveyance path r2. The sub conveyance path r2 is a conveyance path that exists from the reverse point p1 to a junction point p2. On the sub conveyance path r2, the sheet P is conveyed by conveyance roller pairs 51 and 53. On the main conveyance path r1, the junction point p2 is positioned upstream relative to the registration roller pair 16. In this way, the sheet P is passed to the registration roller pair 16 again. The conveyance timing of the sheet P is adjusted by the registration roller pair 16, and then the sheet P is conveyed to the secondary transfer portion T2. When the second surface of the sheet P comes into contact with the intermediate transfer belt 8, a toner image is transferred to the second surface. The fixing device 18 fixes the toner image on the second surface of the sheet P. The flapper 50 guides the sheet P that has completed double-sided printing to the discharge roller pair 20. As a result, the sheet P, which has images formed on both surfaces thereof, is discharged to the discharge tray.

Figure 2:
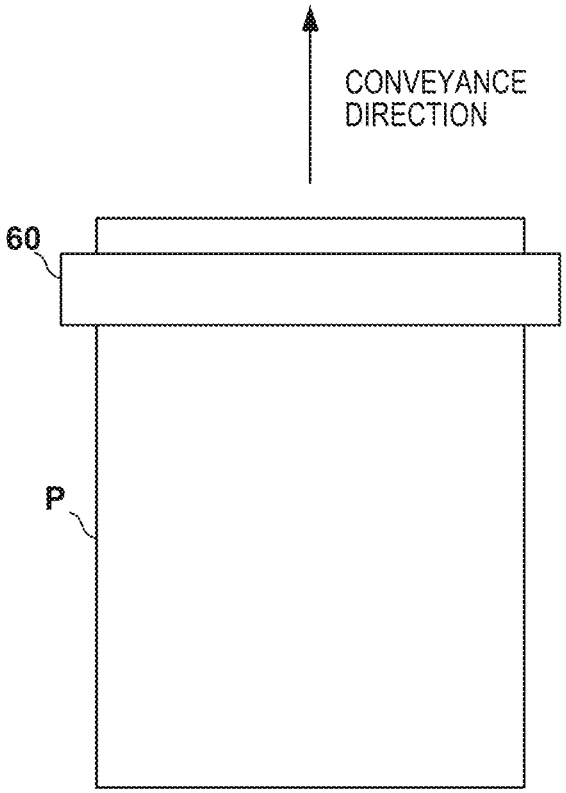
FIG. 2 is a diagram illustrating a region in which a recording material can be read by an image sensor.

Note that an image sensor 60 that reads a surface of the sheet P is provided on the sub conveyance path r2. The image sensor 60 reads a background region and a non-image region on the surface of the sheet P. The background region and the non-image region are similar to each other in that they are both regions in which an image is not formed by intention. However, the surface of the sheet P that has passed through the secondary transfer portion T2 under an image forming condition where no image is formed throughout the entire surface of the sheet P is referred to as the background region. When a region in which a toner image is formed (image formation region) and a region in which no toner image is formed coexist on the surface of the sheet P, the latter region is referred to as the non-image region. That is to say, the non-image region is a region in which no toner image is formed on the surface of the sheet P that has passed through the secondary transfer portion T2 under an image forming condition where an image is formed on a part of the surface of the sheet P. The image sensor 60 has a light-emitting element that illuminates the sheet P, and a light-receiving element that receives reflected light from the sheet P. As shown in FIG. 2, the light-receiving element of the image sensor 60 may be a line sensor that reads an image of the sheet P corresponding to one main scanning line at once. Here, the main scanning direction is the direction that is perpendicular to the conveyance direction of the sheet P. The sub scanning direction is the direction that is perpendicular to the main scanning direction, and is also the direction that is parallel to the conveyance direction. As an option, an image sensor 61 may be added. In this case, the image sensors 60, 61 can read the front and the back of the sheet P in parallel. An optical sensor 70 is a sensor that detects test patterns for density adjustment of toner images formed on the sheet, and test patterns for correcting the formation positions of the toner images (color misregistration correction). In the present example, test patterns formed on the intermediate transfer belt 8 are detected.

<Control in Non-Formation State>

In order to accurately detect toner fogging, it is necessary to accurately measure the background density. In view of this, measurement of the background density is executed in a non-formation state in which the image forming apparatus 100 forms no image on a sheet P. In the non-formation state, theoretically, no toner image is transferred to the sheet P. Therefore, the background density of the sheet P is accurately measured. The non-formation state may be realized by, for example, placing the photosensitive drum 1 and the development roller 3 in a separated state. The non-formation state may also be realized by, for example, placing the photosensitive drum 1 and the intermediate transfer belt 8 in a separated state.

Contact/Separation Mechanism

Figure 3A:
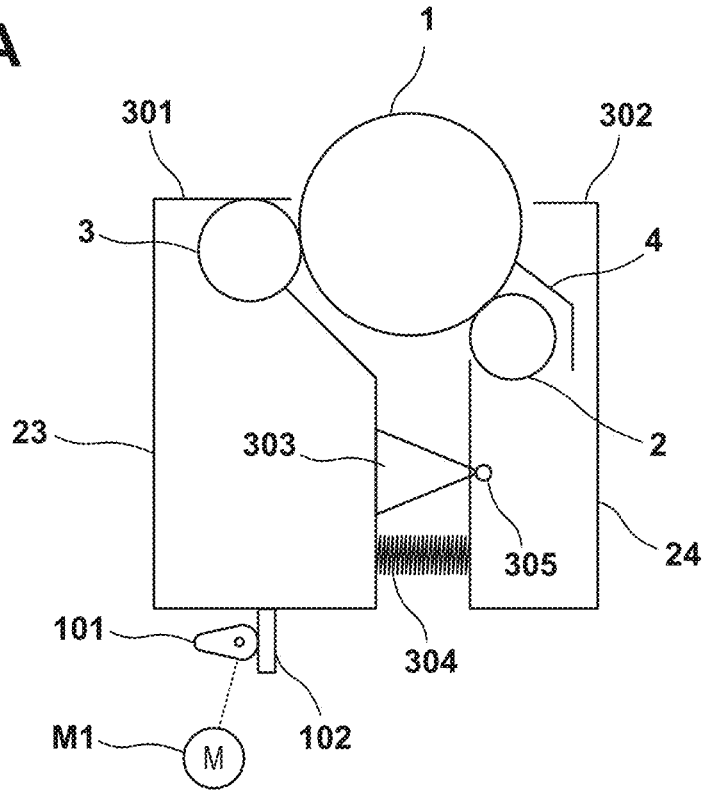
FIGS. 3A and 3B are diagrams showing a contact/separation mechanism for a development roller.
Figure 3B:
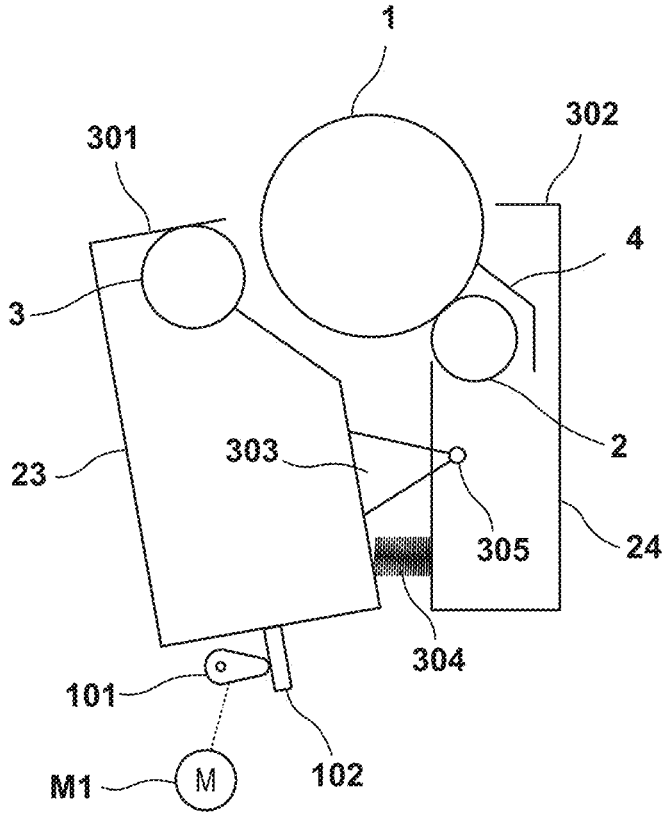

FIG. 3A shows a state of contact between the photosensitive drum 1 and the development roller 3. FIG. 3B shows a state of separation between the photosensitive drum 1 and the development roller 3. As shown in FIG. 3A, the process station 5 includes a first frame body 301 and a second frame body 302. The first frame body 301 supports the development roller 3 and the toner container 23. The second frame body 302 supports the photosensitive drum 1, the charging roller 2, the collection container 24, and so forth. The first frame body 301 is pivotably coupled to the second frame body 302 via a pivot arm 303.

As shown in FIG. 3A, a compression coil spring 304 is disposed between the first frame body 301 and the second frame body 302. Due to a force applied by the compression coil spring 304 and acting on the first frame body 301, the first frame body 301 pivots clockwise with a pivot shaft taxis) 305 of the pivot arm 303 being a fulcrum. This brings the development roller 3 into contact with the photosensitive drum 1. A protrusion-like follower 102 is mounted on a bottom portion of the first frame body 301. As shown in FIG. 3B, the controller 40 causes a cam 101 to rotate by driving a motor M1. As a result, the cam 101 pushes the follower 102, and thus the first frame body 301 pivots counterclockwise with the pivot shaft (axis) 305 being a fulcrum. This causes the development roller 3 to be separated from the photosensitive drum 1.

According to FIG. 3A and FIG. 3B, the contact/separation mechanism is composed of the compression coil spring 304, the motor M1, the follower 102, and the cam 101; however, this is merely an example. It is sufficient for the contact/separation mechanism to be a mechanism that can change a distance between the development roller 3 and the photosensitive drum 1.

Figure 4A:
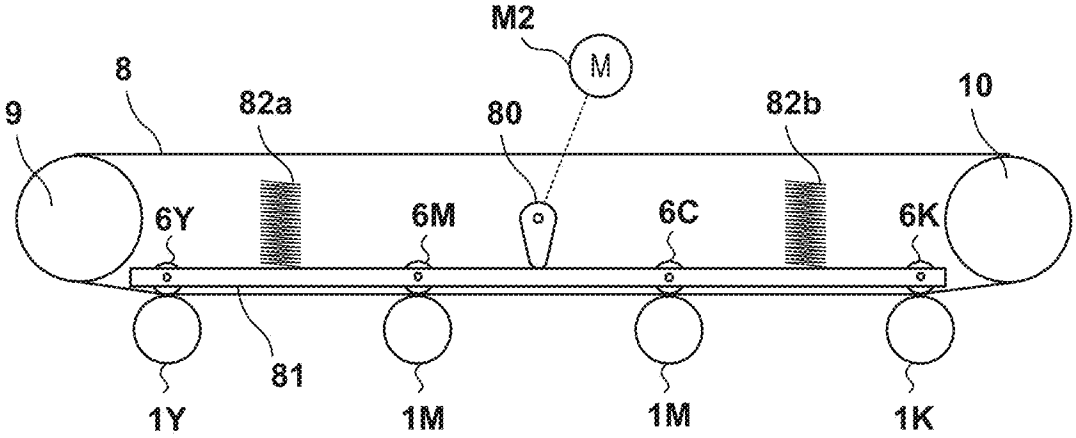
FIGS. 4A and 4B are diagrams showing a contact/separation mechanism for an intermediate transfer belt.
Figure 4B:
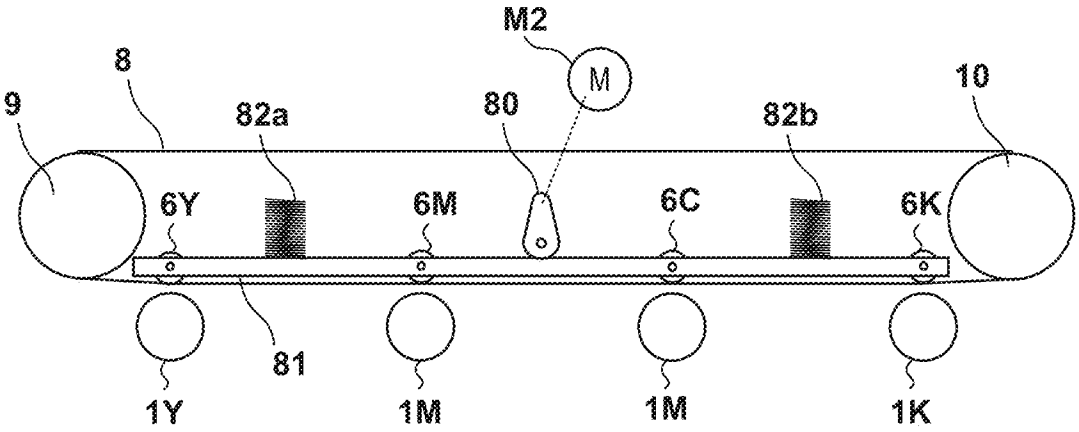

FIG. 4A shows a state of contact between the photosensitive drums 1 and the intermediate transfer belt 8. FIG. 4B shows a state of separation between the photosensitive drums 1 and the intermediate transfer belt 8. Rotation axes of the primary transfer rollers 6 are rotatably supported by a follower 81. Springs 82*a* and 82*b* apply a force to the follower 81. As a motor M2 causes a cam 80 to rotate, the follower 81 moves downward against the force applied by the springs 82*a* and 82*b*. As a result, the primary transfer rollers 6 also move downward, and the primary transfer rollers 6 press an inner circumferential surface of the intermediate transfer belt 8. This brings an outer circumferential surface of the intermediate transfer belt 8 into contact with the photosensitive drums 1. In the state of contact, the length of each of the springs 82*a* and 82*b* is longer than a natural length.

On the other hand, the state of separation shown in FIG. 4B is realized as the controller 40 drives the cam 80 through control on the motor M2. As the cam 80 rotates, the follower 81 and the primary transfer rollers 6 move upward due to a restoring force of the springs 82*a* and 82*b* of restoring to the natural length. As the inner circumferential surface of the intermediate transfer belt 8 also moves upward together with the primary transfer rollers 6, the outer circumferential surface of the intermediate transfer belt 8 is separated from the photosensitive drums 1.

Meanwhile, by causing the photosensitive drum 1 and the development roller 3 to be separated from each other, the life of the development roller 3 can be extended. Similarly, by causing the intermediate transfer belt 8 and the photosensitive drums 1 to be separated from each other, the lives of the intermediate transfer belt 8 and the photosensitive drums 1 can be extended.

Toner Fogging Detection Sequence

While the separated state of the development rollers 3 will be described below, the present embodiment is applicable also with respect to the separated state of the intermediate transfer belt 8. The detection sequence of the present embodiment includes a first reading phase and a second reading phase.

First Reading Phase

In the first reading phase, the controller 40 controls the development rollers 3 to be in the separated state, and causes the photosensitive drums 1 and the intermediate transfer belt 8 to rotate. As a result, on the outer circumferential surface (toner image carrying surface) of the intermediate transfer belt 8, a non-transfer region in which fogging toner attributed to the development rollers 3 is not transferred is formed. The controller 40 controls the registration roller pair 16 so that a sheet P also passes through the secondary transfer portion T2 in synchronization with the timing at which the non-transfer region passes through the secondary transfer portion T2. At this time, a first surface of the sheet P comes into contact with the intermediate transfer belt 8.

The controller 40 conveys the sheet P from the main conveyance path r1 to the sub conveyance path r2 by controlling the flapper 50 and the discharge roller pair 20. The controller 40 conveys the sheet P along the sub conveyance path r2 by driving the conveyance roller pairs 51 and 53. At this time, the controller 40 obtains the background density of the sheet P by reading the first surface of the sheet P using the image sensor 60. In the separated state, fogging attributed to the development rollers 3 is not transferred to the sheet P, and thus the background density of the sheet P can be accurately obtained.

In the present embodiment, the non-formation state refers to a state in which the sheet P is conveyed under an image forming condition where fogging toner is not transferred to the sheet P theoretically. This image forming condition holds when the development rollers 3 and the photosensitive drums 1 are in the separated state and/or when the photosensitive drums 1 and the intermediate transfer belt 8 are in the separated state. Note that in a period in which the non-image region is in contact with the sheet P, the development rollers 3 and the photosensitive drums 1 may return to the contact state.

The non-image region need not be provided throughout the entire region on a surface of the sheet P. For example, the controller 40 may execute conveyance control for the sheet P and control for the contact/separation mechanism so that, on the surface of the sheet P, a region from a leading edge portion to half of the sheet P in the conveyance direction is the non-image region.

The image forming condition for forming the non-image region may be realized by a transfer bias applied to the primary transfer rollers 6 and a transfer bias applied to the secondary transfer roller 11. A transfer bias is generally a voltage for facilitating the transfer of a toner image. In view of this, the image forming condition for forming the non-image region may be application of a transfer bias that inhibits the transfer of a toner image to the primary transfer rollers 6 and the secondary transfer roller 11. As described above, the first reading phase is a sequence of operations for reading the first surface of the sheet P that has been conveyed through the secondary transfer portion T2 in the non-formation state using the image sensor 60.

Second Reading Phase

In the present embodiment, a formation state refers to a state in which an image can be transferred to a sheet P. An image forming condition where the image can be transferred to the sheet P holds when the development rollers 3 and the photosensitive drums 1 are in the contact state and/or when the photosensitive drums 1 and the intermediate transfer belt 8 are in the contact state. Furthermore, this image forming condition includes application of transfer biases that facilitate the transfer of a toner image to the primary transfer rollers 6 and the secondary transfer roller 11. The second reading phase is a sequence of operations for reading a surface of the sheet P that has been conveyed through the secondary transfer portion T2 in the formation state using the image sensor 60.

<Controller>

Figure 5:
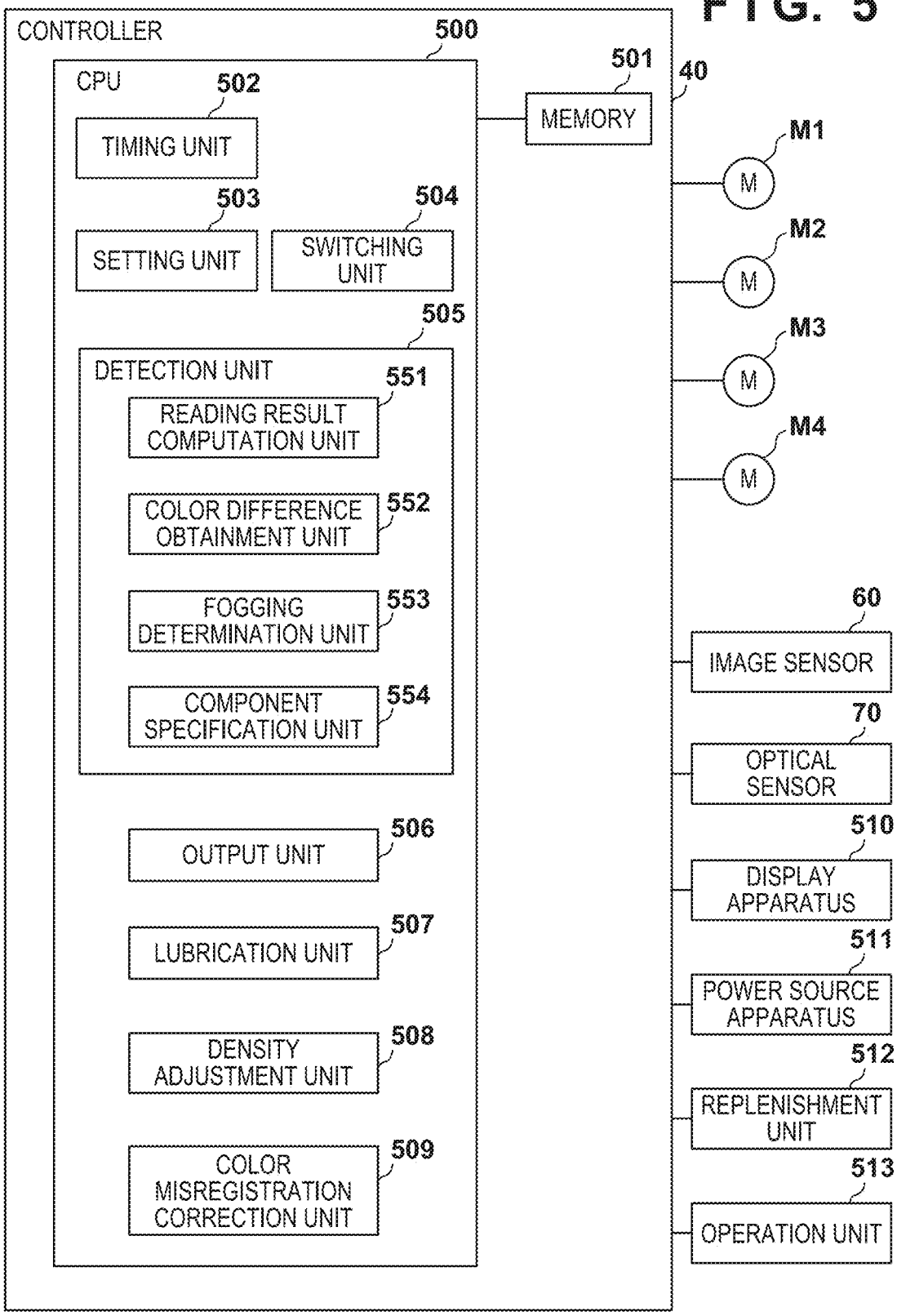
FIG. 5 is a diagram illustrating a controller.

As shown in FIG. 5, the controller 40 may include a CPU 500 and a memory 501. The CPU 500 realizes various functions by executing a control program stored in a ROM region of the memory 501. A part or all of these functions may be realized by a hardware circuit, such as an ASIC or an FPGA. ASIC is an acronym for an application-specific integrated circuit. FPGA is an acronym for a field-programmable gate array. A timing unit 502 controls the execution timing of the fogging detection sequence. A setting unit 503 sets an image forming condition on the image forming apparatus 100. A switching unit 504 switches between the formation state and the non-formation state by controlling the image forming apparatus 100. A detection unit 505 detects toner fogging based on a first reading result and a second reading result. At this time, the detection unit 505 may use, out of the second reading result, a reading result concerning a non-image region in which no image is formed on a surface of a sheet. The first reading result is a result that is obtained by reading the sheet that has passed through the secondary transfer portion T2 set in a first transfer condition (non-formation state). The second reading result is a result that is obtained by reading the sheet that has passed through the secondary transfer portion T2 set in a second transfer condition (formation state). The first transfer condition may be referred to as a first image forming condition, a non-transferrable condition, or a difficult-to-transfer condition. The second transfer condition may be referred to as a second image forming condition, a transferrable condition, or an easy-to-transfer condition. A reading result computation unit 551 computes reading results from image data obtained by the image sensor 60. For example, the reading result computation unit 551 extracts pixel values of a specific region (e.g., a margin portion) in image data obtained from a single sheet P as reading results. A color difference obtainment unit 552 obtains a color difference between color components included in a reading result for the background and color components included in a reading result for the non-image region. A fogging determination unit 553 determines whether there is toner fogging based on the color difference obtained by the color difference obtainment unit 552 and a threshold that has been read out from the memory 501. A component specification unit 554 specifies a toner color that caused fogging based on the color components included in the reading result for the background and the color components included in the reading result for the non-image region. The component specification unit 554 may specify a component (development roller) that needs to be replaced, among the development rollers 3Y, 3M, 3C, and 3K, based on the color components included in the reading result for the background and the color components included in the reading result for the non-image region. An output unit 506 outputs, for example, a message suggesting replacement of the component specified by the component specification unit 554 to a display apparatus 510. A lubrication unit 507 maintains the lubricity property between the photosensitive drums 1 and the cleaning blades 4 by supplying toner to the cleaning blades 4. A density adjustment unit 508 adjusts, for example, a charging bias, a development bias, and a transfer bias generated by a power source apparatus 511 based on a reading result for test patterns formed on the intermediate transfer belt 8, which has been obtained by the optical sensor 70. A color misregistration correction unit 509 corrects color misregistration by adjusting Y, M, C, and K writing timings (image formation positions) based on reading results for respective Y, M, C, and K test patterns formed on the intermediate transfer belt 8. Replenishment units 512 replenish the toner containers 23 with toner from toner bottles, and replenish the development rollers 3 with toner from the toner containers 23. A motor M3 drives the fixing device 18, the conveyance roller pairs 15, 51, and 53, and so forth. A motor M4 drives the discharge roller pair 20.

<Flowchart>

Figure 6:
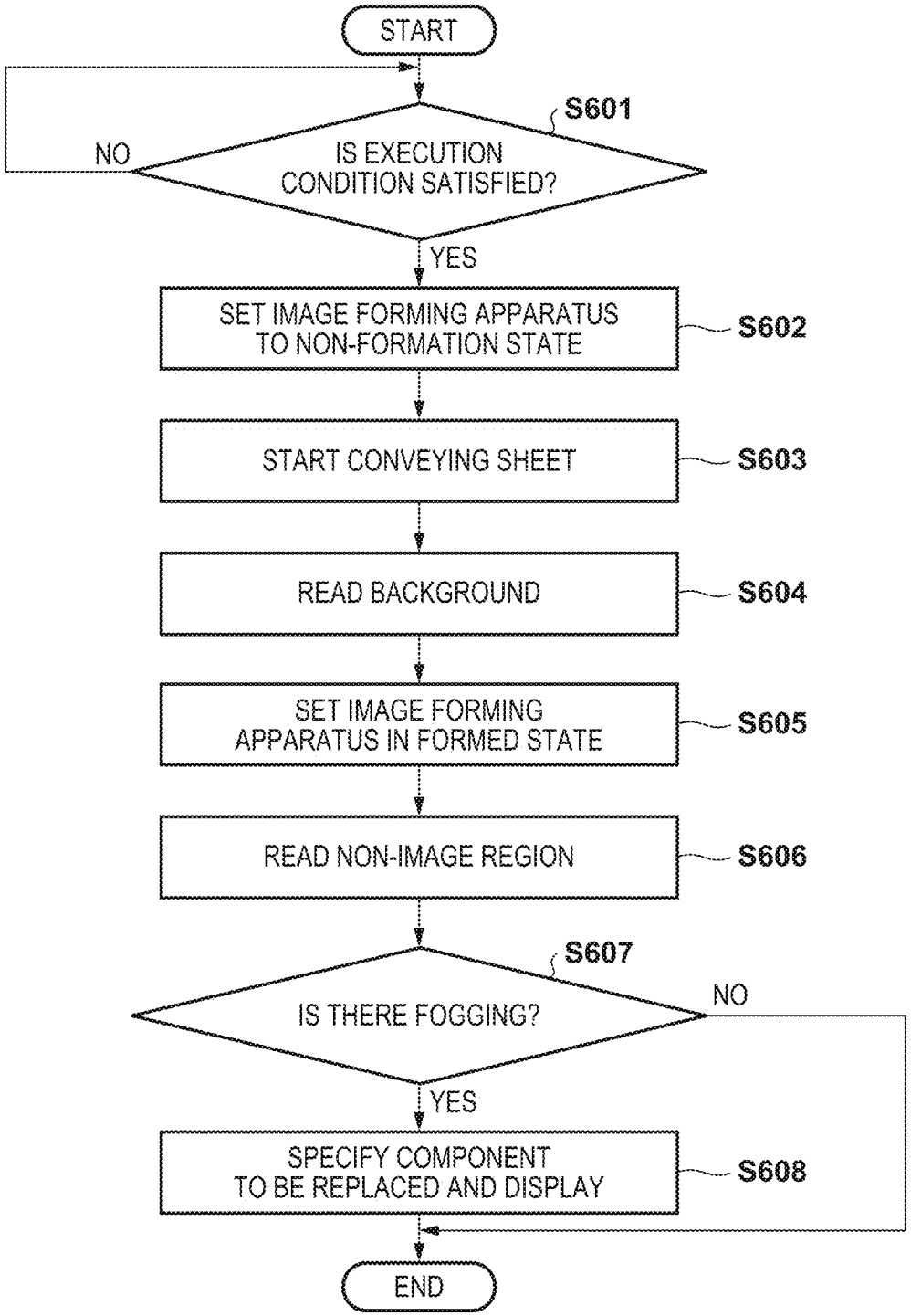
FIG. 6 is a flowchart showing a fogging detection method.

FIG. 6 is a flowchart showing a method of detecting toner fogging.

In step S601, the CPU 500 (timing unit 502) determines whether an execution condition for the detection sequence has been satisfied. For example, the occurrence of a change in a type of a sheet P set in the feeding cassette 13 may be used as the execution condition. The occurrence of the change in the type of the sheet P may be inputting of an instruction for changing the type of the sheet P via an operation unit 513. It may be detection by the CPU 500 of opening and closing of the feeding cassette 13. When the execution condition has been satisfied, the CPU 500 advances the processing to step S602. Note that the execution timing of the detection sequence may be the timing at which the occurrence of fogging is suspected, or the timing at which a print job is interrupted.

In step S602, the CPU 500 (setting unit 503) sets the image forming apparatus 100 in the non-formation state (first transfer condition). For example, when the setting unit 503 has selected the first transfer condition as the image forming condition, the switching unit 504 switches the development rollers 3 from the contact state to the separated state by driving the motor M1, and switches the intermediate transfer belt 8 from the contact state to the separated state by driving the motor M2. This, theoretically, prevents fogging toner from being transferred to the sheet P.

In step S603, the CPU 500 starts conveying the sheet P. By driving the motor M3, the CPU 500 causes the feeding roller 14 to rotate and feeds the sheet P to the main conveyance path r1. The sheet P is conveyed by the conveyance roller pair 15 and the registration roller pair 16, and passes through the secondary transfer portion T2. At this time, a first surface of the sheet P comes into contact with the intermediate transfer belt 8. Furthermore, through control on the motor M4, the CPU 500 drives the discharge roller pair 20 and the flapper 50, and conveys the sheet P to the sub conveyance path r2. The flapper 50 may be driven by a solenoid or the like.

In step S604, the CPU 500 (reading result computation unit 551) reads the background (first surface) of the sheet P using the image sensor 60. As a result, the background density of the sheet P is obtained.

In step S605, the CPU 500 (setting unit 503) sets the image forming apparatus 100 in the formation state (second transfer condition). For example, when the setting unit 503 has selected the second transfer condition as the image forming condition, the switching unit 504 switches the development rollers 3 from the separated state to the contact state by driving the motor M1, and switches the intermediate transfer belt 8 from the separated state to the contact state by driving the motor M2. This, theoretically, allows fogging toner to be transferred to the sheet P. However, when the lives of the development rollers 3 have not been expired, fogging does not occur. Note that until the transition from the non-formation state to the formation state is completed, the CPU 500 may stop the motor M3 and make the sheet P stand by on the sub conveyance path r2.

In step S606, the CPU 500 (reading result computation unit 551) reads a non-image region (second surface) of the sheet P using the image sensor 60. Through control on the motor M3, the CPU 500 drives the conveyance roller pairs 51 and 53 and the registration roller pair 16, and conveys the sheet P to the secondary transfer portion T2 again. At this time, the second surface of the sheet P comes into contact with the intermediate transfer belt 8. Furthermore, through control on the motor M4, the CPU 500 drives the discharge roller pair 20 and the flapper 50, and conveys the sheet P to the sub conveyance path r2. The image sensor 60 reads the second surface of the sheet P, and outputs a reading result to the CPU 500.

In step S607, the CPU 500 (detection unit 505) determines whether there is fogging based on the reading result for the background and the reading result for the non-image region. If there is no fogging, the CPU 500 ends the detection sequence. If there is fogging, the CPU 500 advances the processing to step S608.

In step S608, the CPU 500 (component specification unit 554) specifies a component to be replaced based on the reading result for the background and the reading result for the non-image region, and displays the specified component to be replaced on the display apparatus 510.

<Processing Related to Reading Results>

Background

The reading result may include, for example, density values of R, G, and B color components of respective pixels. For example, the density values may be 8-bit data. The reading result computation unit 551 may perform statistical processing (averaging) with respect to the density values of all pixels obtained from the first surface (background) for respective color components. For example, they may be held in a RAM region of the memory 501 as R, G, and B information (R0, G0, B0) of the background.

Non-Image Region

Figure 7:
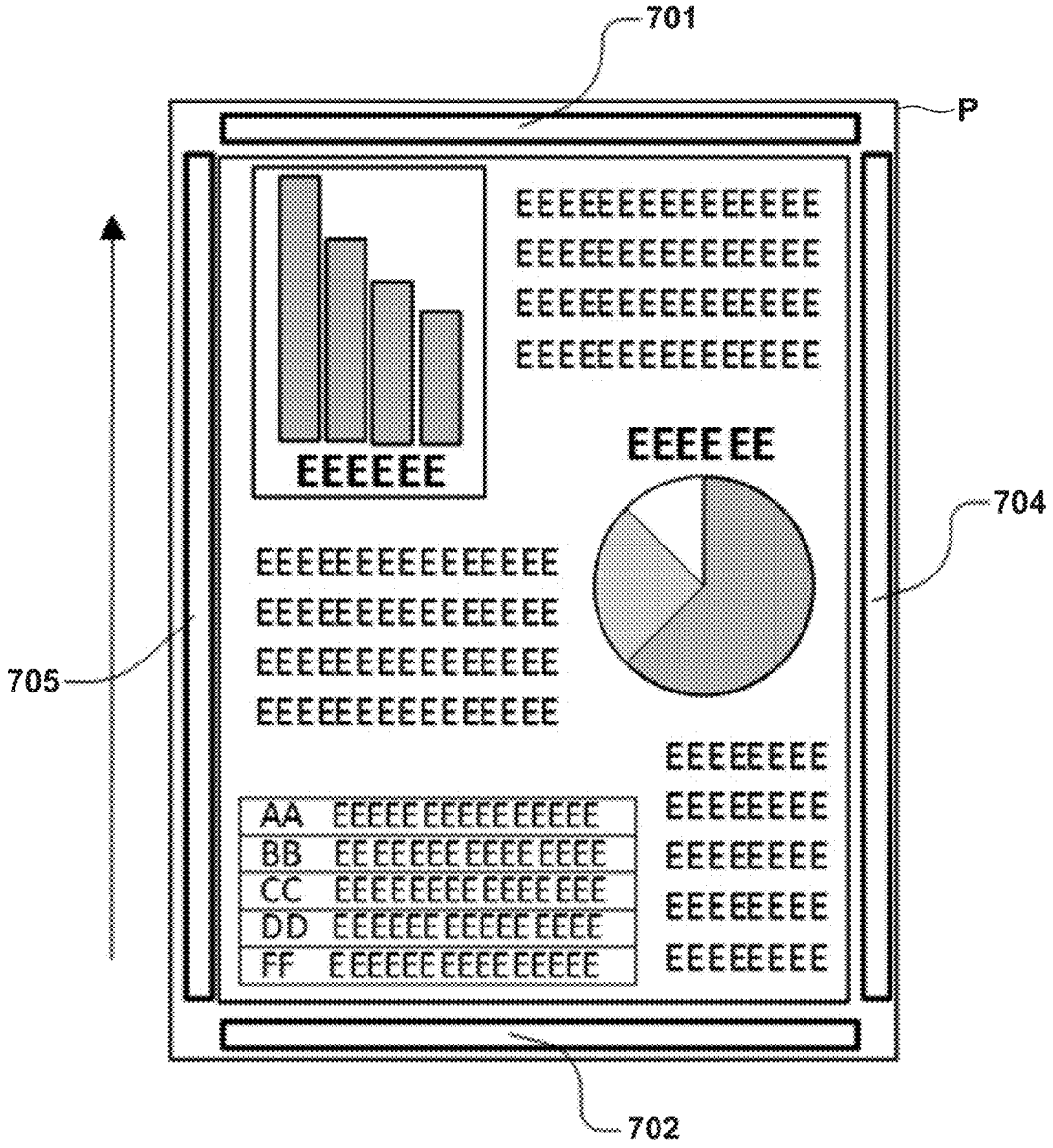
FIG. 7 is a diagram illustrating a non-image region.

The non-image region (second surface) is read in the second reading phase (steps S605 and S606); at this time, an image region may exist on the second surface of the sheet P. FIG. 7 shows an example of the non-image region provided on the second surface of the sheet P. In this example, a leading edge margin 701, a trailing edge margin 702, a left margin 705, and a right margin 704 of the sheet P may be used as the non-image region. The respective positions of the leading edge margin 701, the trailing edge margin 702, the left margin 705, and the right margin 704 on the sheet P are known information. In view of this, the reading result computation unit 551 may extract, out of a reading result for the entire second surface, a reading result for the leading edge margin 701, the trailing edge margin 702, the left margin 705, and the right margin 704 based on the known information. The reading result computation unit 551 may execute statistical computation also with respect to the non-image region, similarly to the background. R, G, and B information for the non-image region (R_p, G_p, and B_p) is also held in the RAM region of the memory 501.

The color difference obtainment unit 552 calculates a color difference E_p between the reading result for the background and the reading result for the non-image region. The color difference dE_p may be, for example, a Euclidean distance in an RGB space.

$$dE_p=((R_p-R0)\hat{}2+(G_p-G0)\hat{}2+(B_p-B0)\hat{}2)\hat{}0.5 \quad (1)$$

The operator "^" denotes exponentiation. This color difference dE_p indicates a color change attributed to fogging toner, and correlates with an amount of fogging toner. The fogging determination unit 553 may determine that fogging has exceeded a permitted value when the color difference dE_p is equal to or larger than a threshold (e.g., 10 dec).

The component specification unit 554 may calculate dE_R, dE_G, and dE_B as fogging information for respective R, G, and B color components.

$$dE_R=R_P-R0 \quad (2)$$

$$dE_G=G_P-G0 \quad (3)$$

$$dE_B=B_P-B0 \quad (4)$$

The component specification unit 554 may specify the component to be replaced based on dE_R, dE_G, and dE_B. Note that the component specification unit 554 may specify the component to be replaced by converting dE_R, dE_G, and dE_B into values in a YMCK color space, and comparing the respective values of Y, M, C, and K with a replacement threshold. For example, when the value of Y is equal to or larger than the replacement threshold, the component specification unit 554 determines the development roller 3Y as the component to be replaced.

<Execution Timing>

Preparation Operation

The timing unit 502 selects the timing at which a print job is not easily interrupted as the execution timing of the detection sequence. For example, upon receiving a print job from a host computer, the CPU 500 executes a preparation operation. The image forming apparatus 100 generally stops the fixing device 18 and the exposure apparatus 7 for the purpose of power saving. It takes a certain waiting period for the temperature of the fixing device 18 to reach a target temperature. Also, it takes a certain waiting period for the rotation speed of rotating polygonal mirrors of the exposure apparatuses 7 to reach a target speed. Therefore, if the background is read during the preparation operation of the image forming apparatus 100, a period in which a user waits due to the fogging detection sequence would be reduced.

Supply of Toner to Cleaning Blades

When the image forming apparatus 100 has executed printing continuously on a large number of sheets P, the image forming apparatus 100 may need to execute a predetermined recovery sequence. The recovery sequence is executed by interrupting a print job. One example of the recovery sequence is an ejection sequence. The ejection sequence is a sequence in which toner is supplied as a lubricant between the cleaning blades 4 and the photosensitive drums 1. As a result of executing continuous printing, a friction force between the cleaning blades 4 and the photosensitive drums 1 increases. With the increase in the friction force, the cleaning blades 4 warp, and toner cannot be accurately collected. This requires the ejection sequence. In the ejection sequence, as it is necessary to supply toner from the development rollers 3 to the photosensitive drums 1, the development rollers 3 are placed in the contact state. Thus, the CPU 500 drives the motor M2, and sets the intermediate transfer belt 8 and the photosensitive drums 1 in the distanced state. In this way, the ejection sequence and the fogging detection sequence are executed in parallel, and thus the waiting periods that are specific to the fogging detection sequence will not be easily incurred. Note that in the ejection sequence, as electrostatic latent images originating from exposure are not formed, the CPU 500 adjusts a development bias through control on the power source apparatus 511. As a result, toner is attached to the surfaces of the photosensitive drums 1. When the ejection sequence ends, the CPU 500 switches from the development bias back to a bias for image formation through control on the power source apparatus 511.

Cooling of Fixing Apparatus

When a large number of sheets P with a relatively small width have passed through the fixing device 18, the temperature at the opposite edge portions of rollers of the fixing device 18 becomes significantly higher than the temperature at the central portions of the rollers. The CPU 500 reduces the temperature at the opposite edge portions by causing the rollers of the fixing device 18 to rotate for a predetermined period. Therefore, the CPU 500 may execute the first reading phase (steps S602, S603) in parallel with cooling of the opposite edge portions of the fixing device 18. This would reduce a period in which a user waits due to the fogging detection sequence.

Toner Replenishment

The CPU 500 replenishes the development rollers 3 with toner from the toner containers 23 by actuating, for example, the replenishment units 512 (agitation screws) provided in the toner containers 23. The CPU 500 may replenish the toner containers 23 with toner from the toner bottles by driving the replenishment units 512. Furthermore, when a two-component developer including toner and carriers is used, the CPU 500 needs to sufficiently charge toner by driving the replenishment units 512. This driving of the replenishment units 512 is generally called toner replenishment. Forming images on a large number of sheets P continuously will cause a shortage of toner supplied to the development rollers 3. In view of this, the CPU 500 executes toner replenishment, for example, each time images are formed on a predetermined number of sheets P. The CPU 500 may execute the first reading phase in parallel with toner replenishment. This would reduce a period in which a user waits due to the fogging detection sequence.

Density Correction

When continuous printing has been executed, the internal temperature of the image forming apparatus 100 may increase, and the density (tone characteristic) of a toner image formed on a sheet P may be displaced from a target density. Through control on the image forming apparatus 100, the density adjustment unit 508 forms test patterns for density adjustment on the intermediate transfer belt 8, and causes the optical sensor 70 to read the test patterns. The density adjustment unit 508 adjusts an image forming condition, such as a charging bias, a development bias, and a primary transfer bias, so that a reading result approaches the target. At this time, the CPU 500 may execute the first reading phase (steps S602 and S603) by placing the intermediate transfer belt 8 in the separated state.

Color Misregistration Correction

When continuous printing has been executed, the internal temperature of the image forming apparatus 100 may increase, and the formation positions of other colors may be displaced from the formation position of a reference color. Full colors are realized by overlaying of Y, M, C, and K toner. Therefore, displacement of the formation positions of other colors from the formation position of the reference color is easily noticeable by humans (color misregistration). Through control on the image forming apparatus 100, the color misregistration correction unit 509 forms test patterns for color misregistration correction on the intermediate transfer belt 8, and causes the optical sensor 70 to read the test patterns. The color misregistration correction unit 509 adjusts the formation positions of other colors relative to the formation position of the reference color so that the formation positions for respective toner colors match one another based on a reading result. At this time, the CPU 500 may execute the first reading phase (steps S602 and S603) by placing the intermediate transfer belt 8 in the separated state.

<Summary>

[First Aspect]

The motors M3, M4, and the like are examples of a conveyance unit that conveys a sheet. The image forming unit 25, which includes the secondary transfer portion T2, is an example of an image forming unit that forms an image by transferring toner to the sheet conveyed by the conveyance unit. The setting unit 503 functions as a setting unit that sets, on the image forming unit, one of a second transfer condition that causes an image to be formed on the sheet and a first transfer condition that does not cause an image to be formed on the sheet. The image sensors 60 and 61 function as a reading unit that generates a first reading result by reading the sheet that has passed through the image forming unit set in the first transfer condition. The image sensors 60 and 61 also function as a reading unit that generates a second reading result by reading the sheet that has passed through the image forming unit set in the second transfer condition. A detection unit 505 functions as a detection unit that detects toner fogging based on the first reading result and a reading result out of the second reading result, the reading result concerning a non-image region in which no image is formed on a surface of the sheet. In particular, according to the present invention, a reading result for the background of the sheet is obtained by reading the sheet that has passed through the image forming unit set in the first transfer condition. Therefore, the reading result for the background of the sheet is obtained more accurately, and thus the precision of detection of toner fogging is improved based on the reading result for the background.

[Second Aspect]

The setting unit 503 sets the first transfer condition on the image forming unit in a first period in which the sheet with no image formed on both of a first surface and a second surface thereof passes through the image forming unit for the first time. The setting unit 503 sets the second transfer condition on the image forming unit in a second period in which the sheet passes through the image forming unit again by being conveyed by the conveyance unit. As a result, theoretically toner fogging does not occur on the first surface, and toner fogging can possibly occur on the second surface. Therefore, the reading result for the background of the sheet is obtained more accurately, and thus the precision of detection of toner fogging is improved based on the reading result for the background. Furthermore, a toner stain may exist inside the image forming apparatus 100. Thus, the longer the distance of conveyance on the conveyance paths, the higher the possibility that the toner stain attaches to the sheet P. This toner stain differs from toner that causes fogging. Therefore, as a result of reading the background in the first period (first reading phase) in which the sheet passes through the image forming unit for the first time, the background density is less susceptible to the toner stain.

[Third Aspect]

In the image forming unit 25, the photosensitive drum 1 is an example of a photosensitive member. The development roller 3 functions as a development unit that forms a toner image by developing an electrostatic latent image formed on the photosensitive member using toner. The switching unit 504 and the motor M1 function as a switching unit that, by causing the development unit and the photosensitive member to move relative to each other, switches between an approaching state in which the development unit and the photosensitive member have approached each other and a separated state in which the development unit and the photosensitive member have been separated from each other. The second transfer condition includes controlling the development unit and the photosensitive member to be in the approaching state (e.g., contact state). The first transfer condition includes controlling the development unit and the photosensitive member to be in the separated state. Thus separating the development unit from the photosensitive member prevents fogging toner attributed to the development unit from being transferred to the sheet P. Therefore, the reading result for the background of the sheet is obtained more accurately.

[Fourth Aspect]

In the image forming unit 25, the intermediate transfer belt 8 is an example of an intermediate transfer member. The primary transfer roller 6 is an example of a primary transfer member that transfers the toner image formed on the photosensitive member to the intermediate transfer member. The secondary transfer roller 11 is an example of a secondary transfer member that transfers the toner image from the intermediate transfer member to the sheet. The switching unit 504 and the motor M2 function as a switching unit that, by causing the intermediate transfer member and the primary transfer member to move relative to each other, switches between an approaching state in which the intermediate transfer member and the primary transfer member have approached each other and a separated state in which the intermediate transfer member and the primary transfer member have been separated from each other. In this case, the second transfer condition includes controlling the intermediate transfer member and the primary transfer member to be in the approaching state (e.g., contact state). The first transfer condition includes controlling the intermediate transfer member and the primary transfer member to be in the separated state.

[Fifth Aspect]

As shown in FIG. 7, the non-image region may be the leading edge margin 701 that is provided on a leading edge side of the sheet in the conveyance direction of the sheet. The non-image region may be the trailing edge margin 702 that is provided on a trailing edge side of the sheet in the conveyance direction of the sheet. The non-image region may be a first margin (e.g., left margin 705) that is provided on one edge side among both edges of the sheet in the direction perpendicular to the conveyance direction of the sheet. The non-image region may be a second margin (e.g., right margin 704) that is provided on the other edge side among the both edges of the sheet in the direction perpendicular to the conveyance direction of the sheet. This eliminates the need to prepare a sheet dedicated to the detection sequence.

[Sixth Aspect]

The conveyance unit may include a conveyance path (e.g., conveyance path r2) via which a contact surface, of a first surface and a second surface of the sheet, that comes into contact with the image forming unit is reversed from the first surface to the second surface. The reading unit may be positioned so as to read the first surface of the sheet conveyed on the conveyance path, and read the second surface when the sheet is conveyed on the conveyance path again.

[Seventh Aspect]

As shown in FIG. 1, the reading unit may include a first sensor (e.g., image sensor 60) that reads a first surface of the sheet conveyed on the conveyance path, and a second sensor (e.g., image sensor 61) that reads a second surface of the sheet. In this case, in the first reading phase, both of the background density of the first surface and the background density of the second surface can be obtained. In the second reading phase, a toner image is formed on the second surface, and a margin on the second surface is read by the image sensor 60. Furthermore, a toner image is formed on the first surface, and a margin on the first surface is read by the image sensor 60. In this case, the sheet P passes the sub conveyance path r2 three times. The CPU 500 may detect fogging with respect to both of the first surface and the second surface of the sheet P separately. In some cases, there is a type of sheet P that has a first surface and a second surface with different background densities. In such cases, an accurate detection result cannot be obtained even if fogging is detected using the background density of the first surface and the density of the non-image region on the second surface. Therefore, by detecting fogging with respect to both of the first surface and the second surface separately, the precision of detection of fogging is improved. Furthermore, when fogging has been detected with respect to both of the first surface and the second surface, the CPU 500 may display a message suggesting replacement of the development roller 3 on the display apparatus 510.

[Eighth Aspect]

The color difference obtainment unit 552 functions as a color difference obtainment unit that obtains a color difference between a plurality of color components included in the second reading result and a plurality of color components included in the first reading result. The fogging determination unit 553 functions as a determination unit that determines whether the color difference is equal to or larger than a threshold for detecting the toner fogging. When the color difference is equal to or larger than the threshold, the detection unit 505 may output information indicating that the toner fogging has occurred. In the image forming apparatus 100, a full-color image is formed by overlaying of Y, M, C, and K toners. Therefore, fogging has mixed colors as well. Thus, by taking advantage of the color difference, fogging is detected more accurately.

[Ninth Aspect]

As has been described in relation to step S608, the component specification unit 554 may specify a toner color that has caused the toner fogging using dE_R, dE_G, and dE_B. dE_R is a first difference, which is a difference between a first color component included in the second reading result and a first color component included in the first reading result. dE_G is a second difference, which is a difference between a second color component included in the second reading result and a second color component included in the first reading result. dE_B is a third difference, which is a difference between a third color component included in the second reading result and a third color component included in the first reading result. This would make it easier for a user to understand which toner color has caused fogging.

[Tenth Aspect]

The output unit 506 and the display apparatus 510 may function as an output unit that, when the toner fogging has been detected, outputs information indicating a component to be replaced that has caused the toner fogging. This would enable a user to easily recognize which component should be replaced.

[Eleventh Aspect]

The timing unit 502 functions as a control unit that controls an execution timing of a detection sequence for detecting the toner fogging. The timing unit 502 causes the image forming apparatus 100 to execute the detection sequence when a predetermined execution condition has been satisfied.

[Twelfth Aspect]

The predetermined execution condition may be, for example, a temporary interruption of a print job. The timing unit 502 may cause the image forming apparatus 100 to execute the detection sequence in a period in which the print job has been temporarily interrupted. This would reduce a waiting period for a user. That is to say, there is no need to interrupt the print job just for the detection sequence.

[Thirteenth Aspect]

The period in which the print job has been temporarily interrupted may be a period in which toner for lubrication between a photosensitive member and a cleaning member (e.g., cleaning blade 4) that cleans the photosensitive member is supplied to the cleaning member, the photosensitive member being provided in the image forming unit. The timing unit 502 may cause the image forming apparatus 100 to execute the detection sequence in the period in which the toner for lubrication is supplied. This would reduce a waiting period for a user. That is to say, there is no need to interrupt the print job just for the detection sequence.

[Fourteenth Aspect]

The period in which the print job has been temporarily interrupted may be a period in which an edge portion of the fixing device 18 provided in the image forming apparatus 100 is cooled. The timing unit 502 may cause the image forming apparatus 100 to execute the detection sequence in the period in which the edge portion of the fixing device 18 is cooled. This would reduce a waiting period for a user. That is to say, there is no need to interrupt the print job just for the detection sequence.

[Fifteenth Aspect]

The period in which the print job has been temporarily interrupted may be a replenishment period in which the development roller 3 is replenished with toner from the toner container 23 provided in the image forming apparatus 100. The timing unit 502 may cause the image forming apparatus 100 to execute the detection sequence in the replenishment period. This would reduce a waiting period for a user. That is to say, there is no need to interrupt the print job just for the detection sequence.

[Sixteenth Aspect]

The period in which the print job has been temporarily interrupted may be a correction period in which a density of a toner image or color misregistration of a toner image is corrected. The timing unit 502 may cause the image forming apparatus 100 to execute the detection sequence in the correction period. This would reduce a waiting period for a user. That is to say, there is no need to interrupt the print job just for the detection sequence.

[Seventeenth Aspect]

The predetermined execution condition may be commencement of a preparation operation of the image forming unit (e.g., exposure apparatus 7) and the conveyance unit (e.g., fixing device 18) that is executed before a print job is executed. The timing unit 502 may cause the image forming apparatus 100 to execute the detection sequence in parallel with the preparation operation or immediately after the preparation operation has ended. In this way, the detection sequence would be executed effectively.

Other Embodiments

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-134015, filed Jul. 19, 2019, which is hereby incorporated by reference herein in its entirety.

What is claimed is:

1. An image forming apparatus comprising:

a conveyance unit configured to convey a sheet;

an image forming unit configured to form an image by transferring toner to the sheet conveyed by the conveyance unit;

a setting unit configured to set a condition of the image forming unit to one of a first transfer condition that does not cause an image to be formed on the sheet and a second transfer condition that causes an image to be formed on the sheet;

a reading unit configured to generate a first reading result by reading the sheet that has passed through the image forming unit set in the first transfer condition, and generate a second reading result by reading the sheet that has passed through the image forming unit set in the second transfer condition; and a detection unit configured to detect toner fogging on the sheet based on the first reading result and a reading result out of the second reading result, the reading result corresponding to a non-image region in which no image is formed on a surface of the sheet.

2. The image forming apparatus according to claim 1, wherein the setting unit is configured to:

set the first transfer condition on the image forming unit in a first period in which the sheet with no image formed on both of a first surface and a second surface thereof passes through the image forming unit for the first time, and set the second transfer condition on the image forming unit in a second period in which the sheet passes through the image forming unit again by being conveyed by the conveyance unit.

3. The image forming apparatus according to claim 1, wherein the image forming unit includes:

a photosensitive member, a development unit configured to form a toner image by developing an electrostatic latent image formed on the photosensitive member using toner, and a switching unit configured to, by causing the development unit and the photosensitive member to move relative to each other, switch between an approaching state in which the development unit and the photosensitive member have approached each other and a separated state in which the development unit and the photosensitive member have been separated from each other, the second transfer condition includes controlling the development unit and the photosensitive member to be in the approaching state, and the first transfer condition includes controlling the development unit and the photosensitive member to be in the separated state.

4. The image forming apparatus according to claim 1, wherein the image forming unit includes:

a photosensitive member, a development unit configured to form a toner image by developing an electrostatic latent image formed on the photosensitive member using toner, an intermediate transfer member, a primary transfer member configured to transfer the toner image formed on the photosensitive member to the intermediate transfer member, a secondary transfer member configured to transfer the toner image from the intermediate transfer member to the sheet, and a switching unit configured to, by causing the intermediate transfer member and the primary transfer member to move relative to each other, switch between an approaching state in which the intermediate transfer member and the primary transfer member have approached each other and a separated state in which the intermediate transfer member and the primary transfer member have been separated from each other, the second transfer condition includes controlling the intermediate transfer member and the primary transfer member to be in the approaching state, and the first transfer condition includes controlling the intermediate transfer member and the primary transfer member to be in the separated state.

5. The image forming apparatus according to claim 1, wherein the non-image region is at least one of:

a leading edge margin that is provided on a leading edge side of the sheet with respect to a conveyance direction of the sheet, a trailing edge margin that is provided on a trailing edge side of the sheet with respect to the conveyance direction of the sheet, a first margin that is provided on one edge side among both edges of the sheet in a direction perpendicular to the conveyance direction of the sheet, and a second margin that is provided on the other edge side among the both edges of the sheet in the direction perpendicular to the conveyance direction of the sheet.

6. The image forming apparatus according to claim 1, wherein the conveyance unit includes a conveyance path via which a contact surface, of a first surface and a second surface of the sheet, that comes into contact with the image forming unit is reversed from the first surface to the second surface, and the reading unit is positioned so as to read the second surface of the sheet conveyed on the conveyance path, and read the first surface when the sheet is conveyed on the conveyance path again.

7. The image forming apparatus according to claim 1, wherein the conveyance unit includes a conveyance path via which a contact surface, of a first surface and a second surface of the sheet, that comes into contact with the image forming unit is reversed from the first surface to the second surface, and the reading unit includes a first sensor configured to read the second surface of the sheet conveyed on the conveyance path, and a second sensor configured to read the first surface of the sheet.

8. The image forming apparatus according to claim 1, wherein the detection unit includes:

a color difference obtainment unit configured to obtain a color difference between a plurality of color components included in the second reading result and a plurality of color components included in the first reading result, and a determination unit configured to determine whether the color difference is equal to or greater than a threshold for detecting the toner fogging, and when the color difference is equal to or greater than the threshold, the detection unit outputs information indicating that the toner fogging has occurred.

9. The image forming apparatus according to claim 1, further comprising:

a specification unit configured to specify a toner color that has caused the toner fogging based on a first difference, a second difference, and a third difference, the first difference being a difference between a first color component included in the second reading result and a first color component included in the first reading result, the second difference being a difference between a second color component included in the second reading result and a second color component included in the first reading result, and the third difference being a difference between a third color component included in the second reading result and a third color component included in the first reading result.

10. The image forming apparatus according to claim 1, further comprising:

an output unit configured to, when the toner fogging has been detected, output information indicating a component to be replaced that has caused the toner fogging.

11. The image forming apparatus according to claim 1, further comprising:

a control unit configured to control an execution timing of a detection sequence for detecting the toner fogging, wherein the control unit causes the image forming apparatus to execute the detection sequence when a predetermined execution condition has been satisfied.

12. The image forming apparatus according to claim 11, wherein the predetermined execution condition is a temporary interruption of a print job, and the control unit causes the image forming apparatus to execute the detection sequence in a period in which the print job has been temporarily interrupted.

13. The image forming apparatus according to claim 12, wherein the period in which the print job has been temporarily interrupted is a period in which toner for lubrication between a photosensitive member and a cleaning member configured to clean the photosensitive member is supplied to the cleaning member, the photosensitive member being provided in the image forming unit, and the control unit causes the image forming apparatus to execute the detection sequence in the period in which the toner for lubrication is supplied.

14. The image forming apparatus according to claim 12, wherein the period in which the print job has been temporarily interrupted is a period in which an edge portion of a fixing apparatus provided in the image forming apparatus is cooled, and the control unit causes the image forming apparatus to execute the detection sequence in the period in which the edge portion of the fixing apparatus is cooled.

15. The image forming apparatus according to claim 12, wherein the period in which the print job has been temporarily interrupted is a replenishment period in which a development roller is replenished with toner from a toner container provided in the image forming apparatus, and the control unit causes the image forming apparatus to execute the detection sequence in the replenishment period.

16. The image forming apparatus according to claim 12, wherein the period in which the print job has been temporarily interrupted is a correction period in which a density of a toner image or color misregistration of a toner image is corrected, and the control unit causes the image forming apparatus to execute the detection sequence in the correction period.

17. The image forming apparatus according to claim 11, wherein the predetermined execution condition is commencement of a preparation operation of the image forming unit and the conveyance unit that is executed before a print job is executed, and the control unit causes the image forming apparatus to execute the detection sequence in parallel with the preparation operation or immediately after the preparation operation has ended.

* * * * *